US010484772B2

(12) United States Patent
Barrieau et al.

(10) Patent No.: US 10,484,772 B2
(45) Date of Patent: Nov. 19, 2019

(54) HIDDEN REAR CAVITY VENT

(71) Applicant: BOSE CORPORATION, Framingham, MA (US)

(72) Inventors: Johnpaul P. Barrieau, Franklin, MA (US); Richard L. Pyatt, Newton, MA (US); Jonathan D. Turner, Bolton, MA (US); Daniel P. Baker, Warwick, RI (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/782,910

(22) Filed: Oct. 13, 2017

(65) Prior Publication Data

US 2019/0116410 A1 Apr. 18, 2019

(51) Int. Cl.
*H04R 1/02* (2006.01)
*H04R 1/10* (2006.01)

(52) U.S. Cl.
CPC ..... *H04R 1/1008* (2013.01); *H04R 1/1058* (2013.01); *H04R 2460/11* (2013.01)

(58) Field of Classification Search
CPC ... H04R 1/1083; H04R 2460/01; H04R 1/086
See application file for complete search history.

(56) References Cited

U.S. PATENT DOCUMENTS 5,729,605 A * 3/1998 Bobisuthi ..... H04R 1/1041 379/430
2009/0180657 A1* 7/2009 Isvan ..... H04R 1/2849 381/371

* cited by examiner

*Primary Examiner* — Amir H Estesam
(74) *Attorney, Agent, or Firm* — Patterson + Sheridan, LLP

(57) ABSTRACT

Aspects of the present disclosure provide an intentional leak from a rear volume of an ear cup to the atmosphere. The leak is created via a vent in the driver plate acoustic assembly. The vent reduces an acoustic load the ear cup cover creates on a rear cavity of an electroacoustic transducer contained within the driver plate acoustic assembly of a headset. Additionally, the vent is hidden on an assembled ear cup of a headset. Due to the placement of the vent, ear cup cover may have a smooth, seamless surface.

16 Claims, 5 Drawing Sheets

HIDDEN REAR CAVITY VENT

BACKGROUND

Aspects of the present disclosure generally relate to headset venting and, more particularly, to creating an intentional air leak that enables air to pass from a rear volume of a driver plate acoustic assembly to space outside of the headset.

SUMMARY

All examples and features motioned herein can be combined in any technically possible manner.

Certain aspects provide a headset. The headset includes an ear cup cover, a driver plate acoustic assembly comprising a vent, and an ear cushion. The ear cup cover is coupled to the driver plate acoustic assembly to form a rear volume of the driver plate acoustic assembly and the driver plate acoustic assembly is coupled to the ear cushion to form a front volume of the driver plate acoustic assembly. The vent provides a path for air to flow from the rear volume of the driver plate acoustic assembly to outside the headset.

According to an aspect, the headset includes an electroacoustic transducer is coupled to the driver plate acoustic assembly via a cover, wherein the cover encloses a rear cavity of the electroacoustic transducer. The headset includes a port acoustically coupling the rear cavity of the electroacoustic transducer to the rear volume of the driver plate acoustic assembly. The vent reduces an acoustic load provided to the rear cavity of the electroacoustic transducer.

According to an aspect, the vent is externally invisible on the headset when the ear cup cover is coupled to the driver plate acoustic assembly and the driver plate acoustic assembly is coupled to the ear cushion. According to an aspect, the path for air to flow is between the ear cup cover and the ear cushion. According to an aspect, the vent is curved and extends along a portion of an outer edge of the driver plate acoustic assembly.

According to an aspect, the driver plate acoustic assembly comprises one or more ridges, configured to create a seal with the ear cushion. According to an aspect, the vent is located radially outward from the one or more ridges.

According to an aspect, the driver plate acoustic assembly comprises one or more snap features, configured to couple the ear cushion to the driver plate acoustic assembly. According to an aspect, the vent is located radially outward from the one or more snap features.

According to an aspect, the ear cup cover comprises a uniform, continuous outer surface. According to an aspect, an opening defined by the vent is between approximately 32-38 square millimeters.

Certain aspects provide a headset. The headset includes a driver plate acoustic assembly comprising a vent, a front volume and a rear volume separated by the driver plate acoustic assembly, an ear cushion at least partially enclosing the front volume, an ear cup cover enclosing the rear volume, an electroacoustic transducer coupled to the driver plate assembly via a cover, wherein the cover encloses a rear cavity of the electroacoustic transducer, and a port acoustically coupling the rear cavity of the electroacoustic transducer to the rear volume. The vent provides a path for air to flow from the rear volume to outside of the headset, the path being disposed between the ear cup cover and the ear cushion.

According to an aspect, the vent reduces an acoustic load the ear cup cover and rear volume create on the rear cavity of the electroacoustic transducer. According to an aspect, the vent reduces an effect of resonances in the headset.

According to an aspect, the vent is externally invisible on the headset when the ear cup cover is coupled to the driver plate acoustic assembly and the driver plate acoustic assembly is coupled to the ear cushion.

According to an aspect, the vent extends along a portion of an outer edge of the driver plate acoustic assembly. According to an aspect, an external surface of the ear cup cover is continuous and seamless.

According to an aspect, driver plate acoustic assembly comprises one or more ridges, configured to create a seal with the ear cushion, and the driver plate acoustic assembly further comprises one or more snap features, configured to secure the ear cushion to the driver plate acoustic assembly. According to an aspect, the vent is located radially outward from the one or more ridges and the one or more snap features.

Certain aspects provide a headset. The headset includes a driver plate acoustic assembly comprising a vent, an ear cup cover coupled to a first side of the driver plate acoustic assembly, an ear cushion coupled to a second side of the driver plate acoustic assembly, an electroacoustic transducer coupled to the driver plate assembly via a cover, wherein the cover encloses a rear cavity of the electroacoustic transducer, and a port acoustically coupling the rear cavity of the electroacoustic transducer to the first side of the driver plate acoustic assembly. The vent is located in a gap between the ear cup cover, the driver plate acoustic assembly, and the ear cushion, and the vent provides a path for air to flow from first side of the driver plate acoustic assembly to outside of the headset.

According to an aspect, the vent reduces an acoustic load provided to the rear cavity of the electroacoustic transducer. According to an aspect, an external surface of the ear cup cover is continuous.

According to an aspect, the vent is continuous and extends along a portion of an outer edge of the driver plate acoustic assembly. According to an aspect, the vent is externally invisible when the ear cup cover is coupled to the first side of the driver plate acoustic assembly and the ear cushion is coupled to the second side of the driver plate acoustic assembly.

According to an aspect, the driver plate acoustic assembly comprises one or more ridges, configured to create a seal with the ear cushion, and the driver plate acoustic assembly further comprises one or more snap features, configured to secure the ear cushion to the driver plate acoustic assembly. According to an aspect, the vent is located radially outward from the one or more ridges and the one or more snap features.

Advantages of the headset described herein include providing a seamless design that allows air to flow outside the ear cup via a rear volume and between an ear cup cover and ear cushion. This flow of air reduces the acoustic load the ear cup cover creates on the rear cavity of an electroacoustic transducer of an ear cup. Other features and advantages will be apparent from the description and the claims.

DETAILED DESCRIPTION

A headphone refers to a device that fits around, on, or in an ear and that radiates acoustic energy into the ear canal. Headphones are sometimes referred to as earphones, earpieces, headsets, earbuds, or sport headphones, and can be wired or wireless. A headphone includes an acoustic driver to transduce audio signals to acoustic energy. The acoustic driver may be housed in an earcup. While some of the figures and descriptions following show a single headphone, a headphone may be a single stand-alone unit or one of a pair of headphones (each including a respective acoustic driver and earcup), one for each ear. A headphone may be connected mechanically to another headphone, for example by a headband and/or by leads that conduct audio signals to an acoustic driver in the headphone. A headphone may include components for wirelessly receiving audio signals. A headphone may include components of an active noise reduction (ANR) system. Headphones may also include other functionality such as a microphone so that they can function as a headset.

Aspects of the present disclosure provide a hidden vent between an ear cup cover and an ear cushion of an ear cup, where the hidden vent enables air to pass from a rear volume of a driver plate acoustic assembly to space outside the headset. The hidden rear volume vent aids in controlling the acoustic load that the ear cup cover creates on a rear cavity of an electroacoustic transducer contained within the driver plate acoustic assembly. Additionally, the vent is externally invisible on an assembled headset, such as when the ear cup cover is coupled to the driver plate acoustic assembly and the driver plate acoustic assembly is coupled to an ear cushion. Therefore, the assembled ear cup has a seamless industrial design which may be visually appealing and desirable to consumers.

Figure 1:
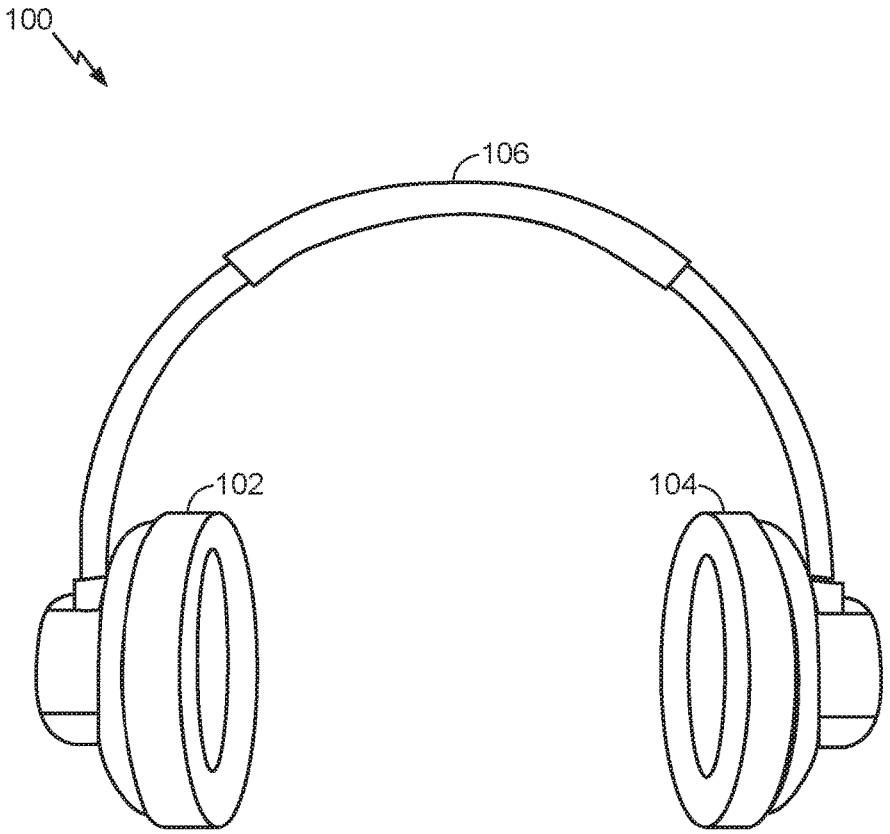
FIG. 1 illustrates an example headset, in accordance with aspects of the present disclosure.

FIG. 1 illustrates an example headset 100, which includes two ear cups 102 and 104 connected by a headband 106.

Figure 2:
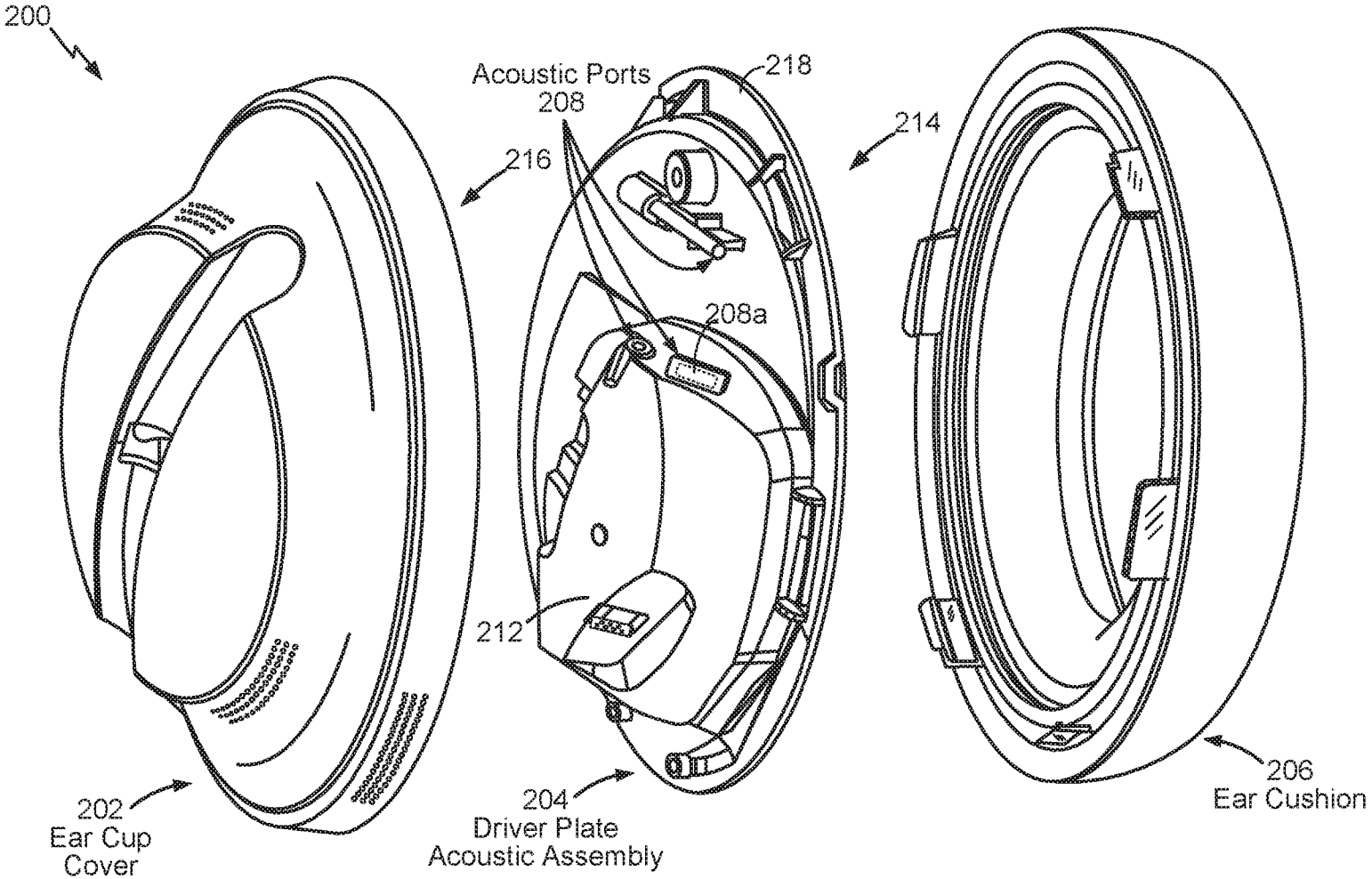
FIG. 2 illustrates an example exploded view of an ear cup, in accordance with aspects of the present disclosure.

FIG. 2 illustrates an example exploded view of an ear cup 200 of headset 100, in accordance with aspects of the present disclosure. The ear cup 200 includes an ear cup cover 202, a driver plate acoustic assembly 204, and an ear cushion 206. The driver plate acoustic assembly 204 includes an electroacoustic transducer (see 308 in FIG. 3), a rear cover or housing 212 for the electroacoustic transducer, a driver plate 218 for positioning the electroacoustic transducer within the ear cup, and one or more acoustic ports 208.

The driver plate acoustic assembly 204 may include a driver plate 218, an electroacoustic driver housing 212, and an electroacoustic transducer. The electroacoustic transducer, which is covered by electroacoustic driver housing 212, is not illustrated in FIG. 2. The electroacoustic driver housing 212 may include one or more ports to couple the rear cavity of the electroacoustic transducer to the rear volume of the driver plate acoustic assembly. For example, port 208*a* of the acoustic ports 208 may couple the rear cavity of the electroacoustic transducer to the rear volume 216 of the driver plate acoustic assembly.

In operation, the electroacoustic transducer moves within an ear cup, to create sound pressure that may be audible to a user of the headset. As can be appreciated, in the example of the headset 100 of FIG. 1, each ear cup 102 and 104 may be similar to ear cup 200 of FIG. 2.

In one example, the driver plate 218 spans the entire ear cup 200, thereby creating a front volume 214 in front of the driver plate acoustic assembly 204 and rear volume 216 behind the driver plate acoustic assembly 204. In an assembled ear cup, the area between the driver plate acoustic assembly 204 and the ear cushion 206 may be referred to as the front volume 214 and the area between the ear cup cover 202 and the driver plate acoustic assembly 204 may be referred to as the rear volume 216. The electroacoustic transducer (see 308 in FIG. 3) also includes a front cavity in front of the electroacoustic transducer, and a rear cavity behind the electroacoustic transducer. For example, the front cavity of the electroacoustic transducer comprises the front volume 214 of the driver plate acoustic assembly, and the rear cavity of the electroacoustic transducer comprises the space behind the electroacoustic transducer as enclosed by the rear cover or electroacoustic driver housing 212.

The acoustic ports 208 vent into the rear volume 216 of the driver plate acoustic assembly. The ports and volumes may be used to tune and shape an acoustic response (i.e., a frequency response) of the ear cup. As an example, the enclosure around the rear volume of the electroacoustic transducer may be tuned in an effort to meet a target acoustic response. The ear cup cover may modify the acoustic response if it couples too closely to the exits of the ports. This is because the ports of the driver plate acoustic assembly are venting into a closed volume (the rear volume 216 enclosed by the ear cup cover) as opposed to the open atmosphere. For the headset to meet a target acoustic response, it is important to control the acoustic load that the ear cup cover 202 and rear volume 216 of the driver plate acoustic assembly create on the rear cavity of the electroacoustic transducer. According to aspects of the present disclosure, the driver plate acoustic assembly advantageously includes a vent to reduce the effect of resonances in the ear cup and headset.

Therefore, aspects of the present disclosure provide a hidden vent from the rear volume of the driver plate acoustic assembly to the open atmosphere. In an assembled ear cup, the hidden rear cavity vent provides a path for air to flow from the rear volume of the driver plate acoustic assembly to outside of the headset. More specifically, air flows through the rear volume and to the open atmosphere between the ear cup cover and the ear cushion. Additionally, as will be described further below, the vent is hidden on an assembled ear cup. The vent reduces the acoustic load provided by the ear cup cover and rear volume of the driver plate acoustic assembly on the rear cavity of the electroacoustic driver. In certain scenarios, because of the placement of the vent, the ear cup cover and rear volume of the driver plate acoustic assembly may not create an acoustic load on the rear cavity of the electroacoustic transducer.

Figure 3:
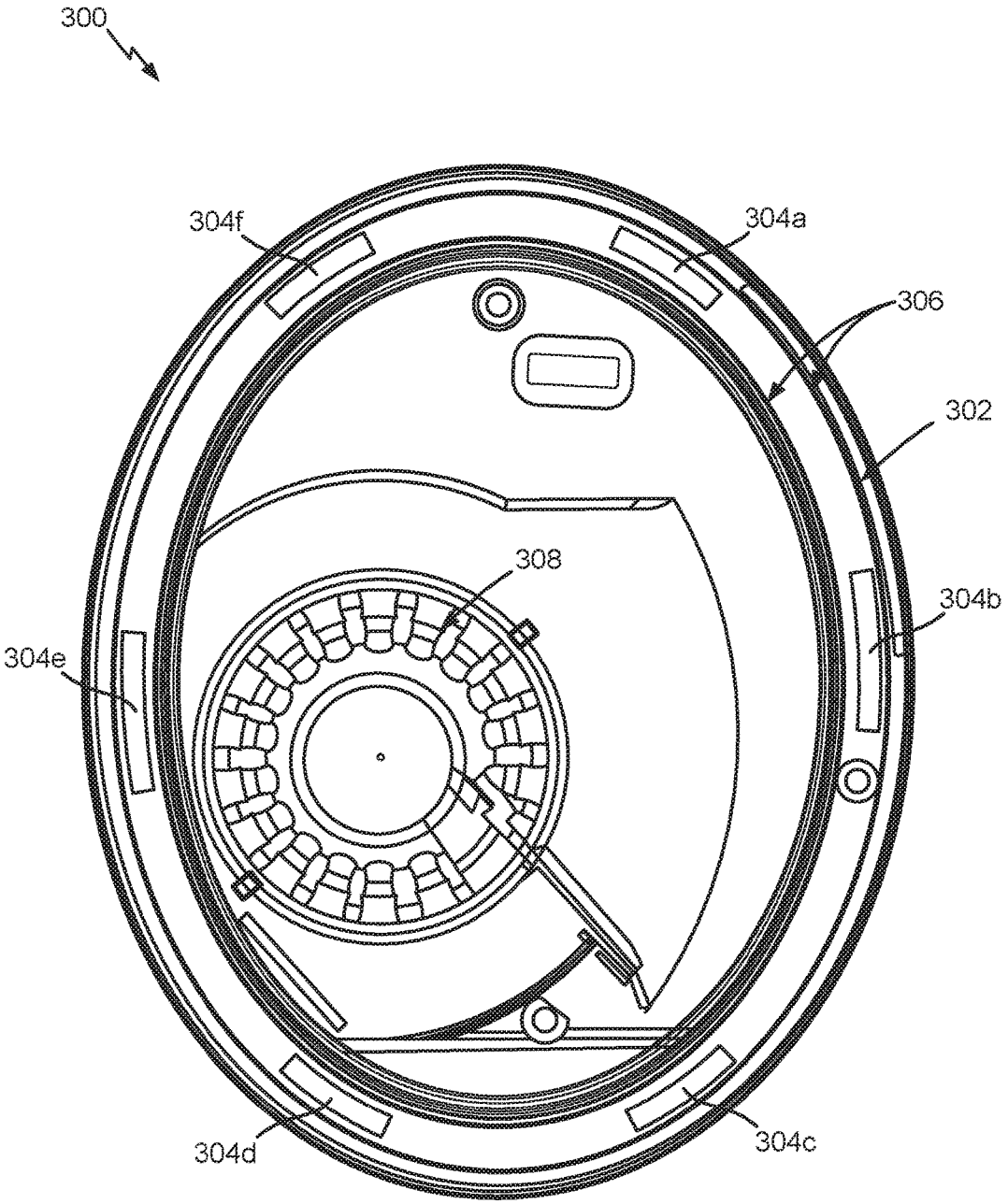
FIG. 3 illustrates a driver plate acoustic assembly including a hidden rear cavity vent, in accordance with aspects of the present disclosure.

FIG. 3 illustrates a driver plate acoustic assembly 300 including a hidden rear cavity vent, in accordance with aspects of the present disclosure. The driver plate acoustic assembly includes a vent 302 for allowing air to flow from the rear volume of the driver plate acoustic assembly to outside the ear cup and headset. The vent 302 is curved in shape, defines a single opening such that the vent is continuous, and extends along a portion of an outer edge or perimeter of the driver plate acoustic assembly 300. As will be described with respect to FIG. 4, the vent 302 is hidden on an assembled ear cup.

The driver plate acoustic assembly 300 may include snap features 304*a*-304*f* on which the ear cushion attaches. The driver plate acoustic assembly may have any number of snap features. In some examples, the vent 302 is located radially outward from the snap features to prevent creating an air leak in the front volume of the driver plate acoustic assembly. The placement of the snap features 304*a*-304*f* so that they are radially inward from the vent allows the vent to provide an air flow path outside of the assembled ear cup from the rear volume and through an area between the ear cup cover and the ear cushion. The placement of the vent radially outward relative to the snap features advantageously maintains an unbroken seal between the ear cushion and the front volume.

The vent 302 is also located radially outward of ridges 306 on the driver plate acoustic assembly 300. The ridges 306 create a seal with the ear cushion to prevent an air leak in the front volume of the driver plate acoustic assembly. Each of the ridges is continuous around the perimeter of the driver plate acoustic assembly. The ear cushion snaps into the snap features 304*a*-304*f* and is sealed to the ridges 306. Therefore, the ear cushion is continuously sealed with the front volume of the driver plate acoustic assembly 300. Air flows through the vent 302 to exit the ear cup while preserving a seal between the ear cushion and the front volume of the driver plate acoustic assembly.

When an ear cup, including the driver plate acoustic assembly 300, is placed on a user's ear, the ear cushion compresses. The design, size, and location of the vent 302 take into account the compression of the ear cushion when the ear cup is worn, and guarantee an appropriate amount of open area is present for venting while not allowing the ear cushion to roll into and/or block the vent. For example, as shown in FIG. 3, the vent may be shaped to have a relatively smaller width compared to its length, and may be located radially outward from the attachment point for the ear cushion, each of which help to prevent the ear cushion from rolling into and/or blocking the vent. The vent opening may be between approximately 32-38 square millimeters. According to one example, the vent opening may be 35 square millimeters. According to another example, the vent opening may be any size (smaller or larger than 35 millimeters) such that an open area is present for venting from a volume defined by the ear cup and the driver plate acoustic assembly to control the acoustic load placed on the rear volume defined by the electroacoustic transducer and the driver plate acoustic assembly while not allowing the ear cushion to roll into and/or block the vent.

Figure 4:
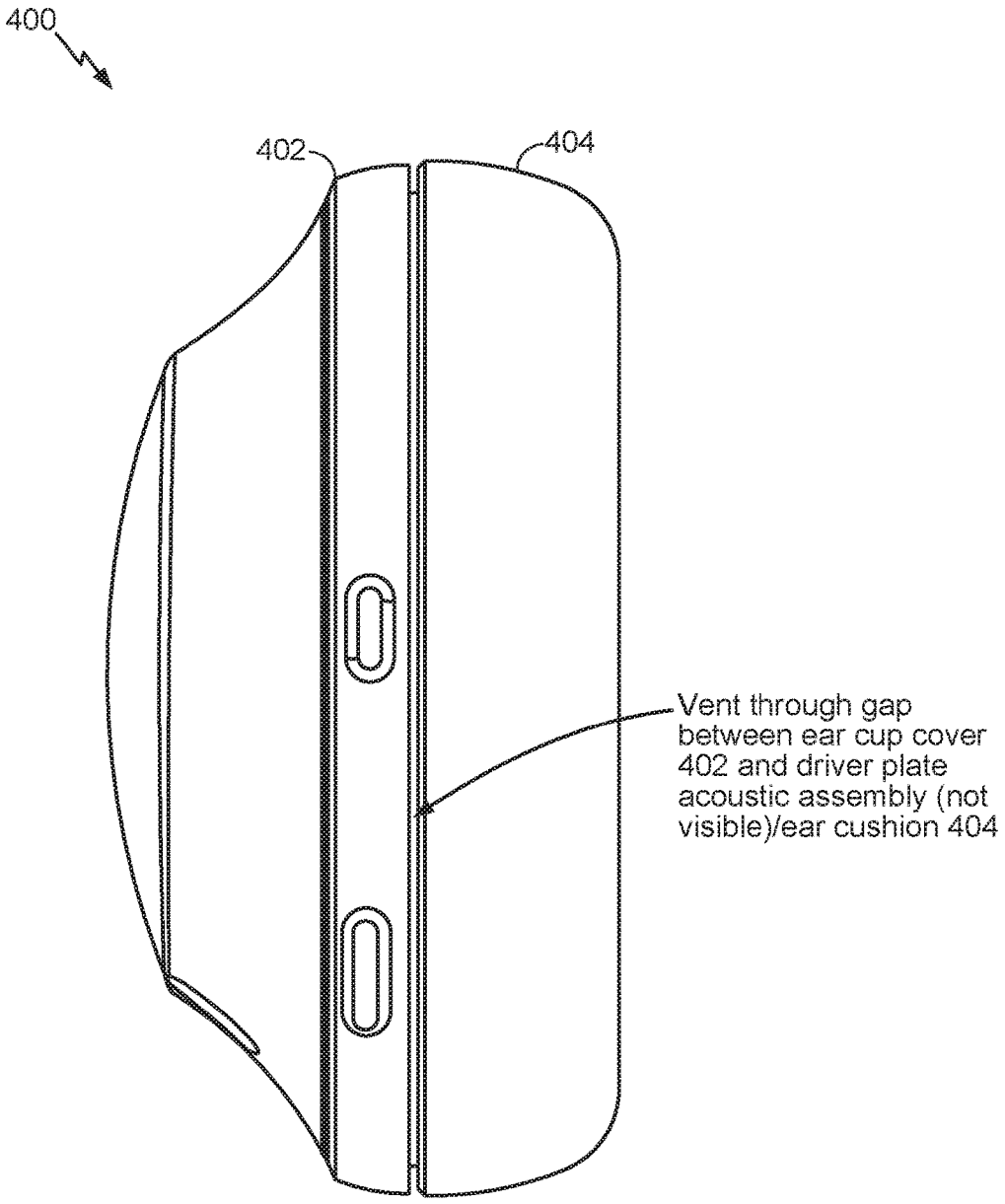
FIG. 4 illustrates a side view of an assembled ear cup, in accordance with aspects of the present disclosure.

FIG. 4 illustrates a side view of an assembled ear cup 400, in accordance with aspects of the present disclosure. The ear cup cover 402 is coupled to the driver plate acoustic assembly and the driver plate acoustic assembly is coupled to the ear cushion 404. The driver plate acoustic assembly is not externally visible on an assembled ear cup.

The ear cup cover 402 encloses a rear volume between the ear cup cover and the driver plate acoustic assembly. The ear cushion 404 encloses a front volume between the driver plate acoustic assembly and the ear cushion. Because the ear cup 400 is assembled, the vent located between the ear cup cover and the driver plate acoustic assembly/ear cushion is not visible in FIG. 4.

Placement of the vent on the driver plate acoustic assembly rather than on the ear cup itself allows the ear cup cover 402 to have a uniform, continuous outer surface. The ear cup cover 402 may be free of holes, seams, or other openings that may be used to provide an acoustic leak from the rear volume of the driver plate acoustic assembly because the leak is instead provided by the hidden rear cavity vent in the driver plate acoustic assembly. This allows the ear cup cover to have a seamless design which is visually desirable to achieve certain design visions.

Figure 5:
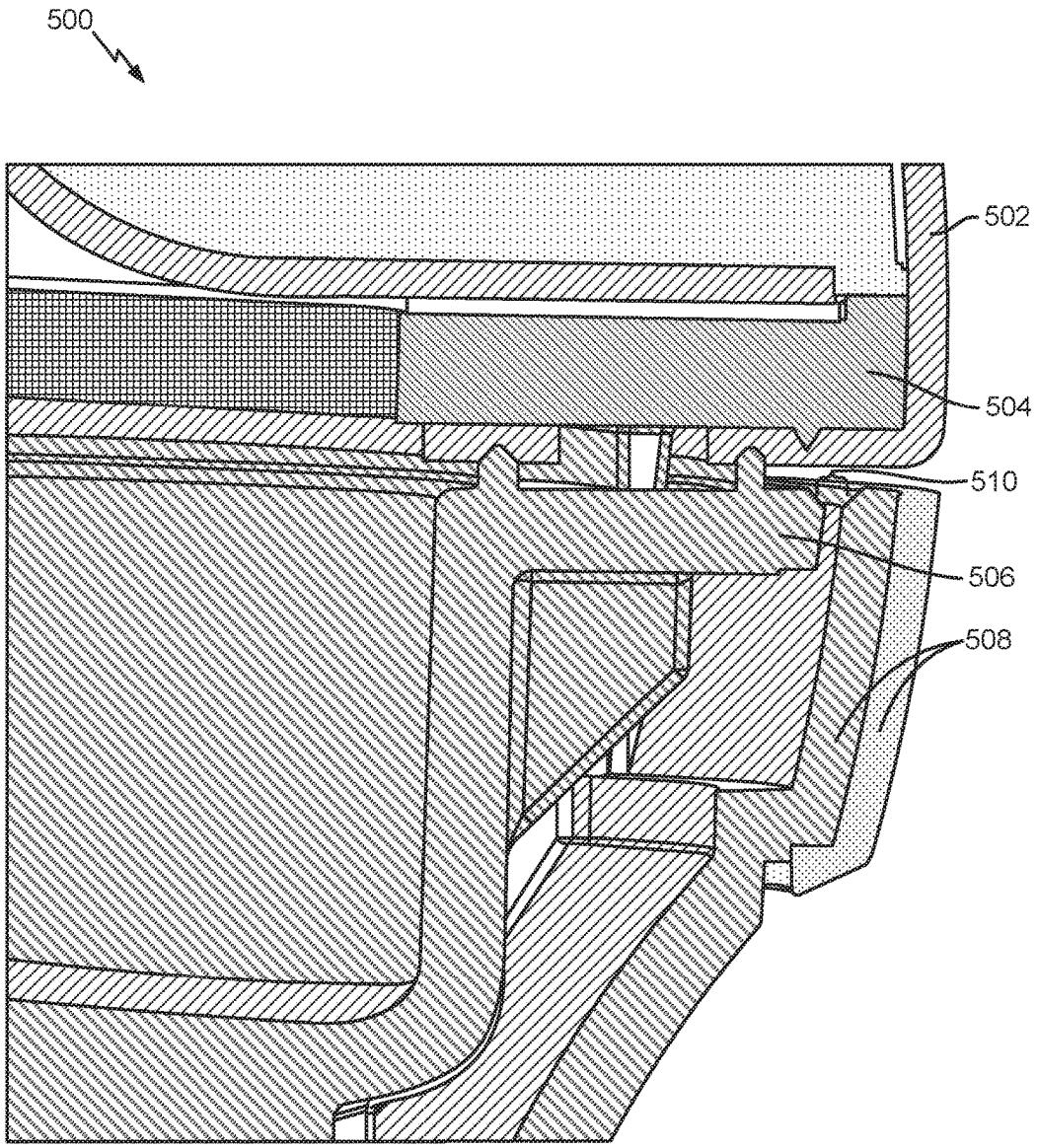
FIG. 5 illustrates an example cross section of a portion of an ear cup, including a gap between the ear cushion and the ear cup cover, in accordance with aspects of the present disclosure.

FIG. 5 illustrates a cross-sectional portion of an ear cup 500, in accordance with aspects of the present disclosure. The ear cup includes an ear cushion 502, a driver plate acoustic assembly 506, and an ear cup cover 508. A rigid ring 504 inside the ear cushion 502 affixes the ear cushion 502 to the driver plate acoustic assembly 506. While not illustrated in FIG. 5, the driver plate acoustic assembly 506 is coupled to the ear cup cover 508. A hidden vent 510 is located in a gap between the ear cup cover 508, the driver plate acoustic assembly 506, and the ear cushion 502. The vent 510 provides a path for air to flow outside of the headset from the rear volume of the driver plate acoustic assembly 506 and through an opening between the ear cup cover 508 and the ear cushion 502.

Aspects of the present disclosure create an intentional leak from a rear volume of an ear cup assembly to outside the ear cup while maintaining a seamless ear cup cover. The leak is positioned between the ear cushion and the ear cup cover due to a vent in a driver plate acoustic assembly. The vent couples the rear volume of the driver plate acoustic assembly to the outside world.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but is to be accorded the widest scope consistent with the principles and novel features disclosed herein.

The invention claimed is:

1. A headset comprising a first ear cup connected by a headband to a second ear cup, the first ear cup comprising:

a driver plate acoustic assembly comprising a vent, the driver plate acoustic assembly spanning the entire first ear cup;

a front volume and a rear volume separated by the driver plate acoustic assembly;

an ear cushion at least partially enclosing the front volume;

an ear cup cover enclosing the rear volume;

an electroacoustic transducer coupled to the driver plate assembly via a cover, wherein the cover encloses a rear cavity of the electroacoustic transducer; and a port acoustically coupling the rear cavity of the electroacoustic transducer to the rear volume, wherein the vent provides a path for air to flow from the rear volume to outside of the headset, the path extending from the vent through a gap between the ear cup cover and the ear cushion.

2. The headset of claim 1, wherein the vent reduces an acoustic load the ear cup cover and rear volume create on the rear cavity of the electroacoustic transducer.

3. The headset of claim 1, wherein the vent reduces an effect of resonances in the headset.

4. The headset of claim 3, wherein the vent is externally invisible on the headset when the ear cup cover is coupled to the driver plate acoustic assembly and the driver plate acoustic assembly is coupled to the ear cushion.

5. The headset of claim 1, wherein the vent extends along a portion of an outer perimeter of the driver plate acoustic assembly.

6. The headset of claim 1, wherein an external surface of the ear cup cover is continuous and seamless.

7. The headset of claim 1, wherein the driver plate acoustic assembly comprises one or more ridges, configured to create a seal with the ear cushion, and the driver plate acoustic assembly further comprises one or more snap features, configured to secure the ear cushion to the driver plate acoustic assembly.

8. The headset of claim 7, wherein the vent is located radially outward from the one or more ridges and the one or more snap features.

9. A headset comprising a first ear cup connected by a headband to a second ear cup, the first ear cup comprising:

a driver plate acoustic assembly comprising a vent, the driver plate acoustic assembly spanning the entire first ear cup;

an ear cup cover coupled to a first side of the driver plate acoustic assembly;

an ear cushion coupled to a second side of the driver plate acoustic assembly;

an electroacoustic transducer coupled to the driver plate assembly via a cover, wherein the cover encloses a rear cavity of the electroacoustic transducer; and a port acoustically coupling the rear cavity of the electroacoustic transducer to the first side of the driver plate acoustic assembly, wherein the vent is located in a gap between the ear cup cover, the driver plate acoustic assembly, and the ear cushion, and the vent provides a path for air to flow from a first side of the driver plate acoustic assembly to outside of the headset through the gap between the ear cup cover and the ear cushion.

10. The headset of claim 9, wherein the vent reduces an acoustic load provided to the rear cavity of the electroacoustic transducer.

11. The headset of claim 9, wherein an external surface of the ear cup cover is continuous.

12. The headset of claim 9, wherein the vent is continuous and extends along a portion of an outer perimeter of the driver plate acoustic assembly.

13. The headset of claim 9, wherein the vent is externally invisible when the ear cup cover is coupled to the first side of the driver plate acoustic assembly and the ear cushion is coupled to the second side of the driver plate acoustic assembly.

14. The headset of claim 9, wherein the driver plate acoustic assembly comprises one or more ridges, configured to create a seal with the ear cushion, and the driver plate acoustic assembly further comprises one or more snap features, configured to secure the ear cushion to the driver plate acoustic assembly.

15. The headset of claim 14, wherein the vent is located radially outward from the one or more ridges and the one or more snap features.

16. The headset of claim 1, wherein the vent is curved in shape.

* * * * *